US006671981B2

(12) United States Patent
Brooks

(10) Patent No.: US 6,671,981 B2
(45) Date of Patent: Jan. 6, 2004

(54) FOOTWEAR

(75) Inventor: Jeffrey S. Brooks, Ladue, MO (US)

(73) Assignee: Jeffrey S. Brooks, Inc., Creve Coeur, MO (US)

( * ) Notice: Subject to any disclaimer, the term of this patent is extended or adjusted under 35 U.S.C. 154(b) by 0 days.

(21) Appl. No.: 09/921,957

(22) Filed: Aug. 3, 2001

(65) Prior Publication Data

US 2002/0020081 A1 Feb. 21, 2002

Related U.S. Application Data

(60) Provisional application No. 60/223,437, filed on Aug. 4, 2000.

(51) Int. Cl.[7] ..... A43B 7/30

(52) U.S. Cl. ..... 36/95; 36/93; 36/71; 36/55

(58) Field of Search ..... 36/93, 94, 95, 36/88, 71, 10, 55, 45, 140

(56) References Cited

U.S. PATENT DOCUMENTS

| | | | | | |
|---|---|---|---|---|---|
| 1,020,160 | A | | 3/1912 | Rowe | |
| 1,055,768 | A | | 3/1913 | Levee et al. | |
| 1,958,619 | A | | 5/1934 | Handler | |
| 2,061,540 | A | * | 11/1936 | MacDonald et al. | 36/96 |
| 2,075,552 | A | * | 3/1937 | Stemmons | 128/894 |
| 2,261,041 | A | * | 10/1941 | Tennant | 128/894 |
| 2,312,911 | A | * | 3/1943 | Jewtraw | 36/71 |
| 2,332,473 | A | * | 10/1943 | Salander | 128/894 |
| 2,821,032 | A | | 1/1958 | Helfet | |
| 2,828,555 | A | | 4/1958 | Ledos | |
| 2,918,059 | A | * | 12/1959 | Levitt | 128/894 |
| 2,918,734 | A | * | 12/1959 | Hyde | 280/11.36 |
| 3,068,872 | A | | 12/1962 | Brody | |
| 3,309,797 | A | | 3/1967 | Poitras | |
| 3,419,974 | A | * | 1/1969 | Lange | 36/117.6 |
| 3,726,287 | A | * | 4/1973 | Wikler | 36/176 |
| 3,750,310 | A | * | 8/1973 | Messner et al. | 36/117.6 |
| 4,633,877 | A | | 1/1987 | Pendergast | |
| 4,704,808 | A | | 11/1987 | Bianchini et al. | |
| 4,726,126 | A | | 2/1988 | Bernhard | |
| 4,864,739 | A | | 9/1989 | Maestri | |
| 4,869,001 | A | | 9/1989 | Brown | |
| 4,876,806 | A | | 10/1989 | Robinson et al. | |
| 4,882,856 | A | | 11/1989 | Glancy | |
| 4,977,691 | A | | 12/1990 | Orchard, 3rd | |
| 5,067,257 | A | * | 11/1991 | Coomer | 36/117.6 |
| 5,092,347 | A | * | 3/1992 | Shaffer et al. | 128/892 |
| 5,146,698 | A | | 9/1992 | Tilles et al. | |
| 5,384,973 | A | | 1/1995 | Lyden | |
| 5,408,761 | A | | 4/1995 | Gazzano | |
| 5,924,218 | A | * | 7/1999 | Dalvy et al. | 36/55 |
| 6,023,857 | A | | 2/2000 | Vizy et al. | |
| 6,041,524 | A | | 3/2000 | Brooks | |

FOREIGN PATENT DOCUMENTS

| | | |
|---|---|---|
| EP | 0 350 517 A1 | 1/1990 |
| FR | 2.015.914 | 4/1970 |
| GB | 217833 | 6/1924 |

OTHER PUBLICATIONS

Brooks, Visser and Duddy, "Mid–West Podiatry and Associates, Inc.", brochure, 8 pages.

* cited by examiner

*Primary Examiner*—M. D. Patterson
(74) *Attorney, Agent, or Firm*—Senniger, Powers, Leavitt & Roedel

(57) ABSTRACT

Footwear including a sole for supporting a foot and an upper attached to the sole for covering the foot. The sole and upper define an interior of the footwear sized and shaped for receiving the foot. The upper has an inner surface adapted for engaging the foot when it is received in the interior of the footwear and an outer surface forming an exterior of the footwear. The upper also includes compressible cushioning permitting the upper to conform to the foot when it is received in the interior of the footwear to improve the fit of the footwear. The compressible cushioning is sized, shaped and positioned in the upper to at least partially surround a protrusion extending from the foot and is at least partially omitted from an area of the upper corresponding to the protrusion. Thus, a recess is formed in the upper for accommodating the protrusion to relieve pressure applied to the foot by the upper at the protrusion. The protrusions which are thus accommodated include protrusions at the heads of the first and fifth metatarsals, a portion of the fifth toe corresponding to the fifth proximal phalanx, and portions of the ankle corresponding to the distal heads of the tibia and fibula.

16 Claims, 12 Drawing Sheets

FOOTWEAR

CROSS-REFERENCE TO RELATED APPLICATION

This application claims priority from U.S. Provisional Patent Application Ser. No. 60/223,437 filed Aug. 4, 2000, which is hereby incorporated by reference.

BACKGROUND OF THE INVENTION

The present invention relates generally to footwear, and more particularly to footwear having recesses for accommodating protrusions of the foot.

As illustrated in FIGS. 1–3, typical human feet, designated by the reference character O, have protrusions resulting from skeletal structures beneath the skin. For example, a head H1 of a first metatarsal M1 and a base B1 of a first proximal phalanx P1 cause a protrusion at a base of a first toe T1 (i.e., the great toe) which extends from the foot in a medial direction X1 (i.e., toward a centerline of the body) as shown in FIG. 2. A head H5 of a fifth metatarsal M5 and a base B5 of a fifth proximal phalanx P5 cause a protrusion at a base of a fifth toe T5 which extends from the foot in a lateral direction X2 (i.e., away from the centerline of the body). Further, the fifth proximal phalanx P5 of the fifth toe T5 extends farther laterally than a fifth middle phalanx MP5 and a fifth distal phalanx DP5 so the proximal phalanx forms a protrusion on the fifth toe immediately in front of the protrusion caused by the head H5 of the fifth metatarsal M5 as shown in FIG. 2. Several protrusions are caused by metatarsal and mid-tarsal bones MT which protrude upward from the top of the foot O as shown in FIG. 1. Further, distal heads of the tibia and fibula, designated by T and F, respectively, form protrusions extending medially and laterally outward from an ankle A as illustrated in FIG. 3.

Typical footwear has an upper attached to a sole. The upper surrounds the foot O to retain it in position inside the footwear when walking or running. As the foot O moves inside the footwear, the upper exerts pressure on features of the foot including the previously described protrusions. The protrusions also move relative to the upper, causing friction between the upper and the skin covering the protrusions. Sometimes the pressure and friction cause ailments such as swelling and irritation of the skin and underlying tissue. Some conventional footwear has extra padding in some of the areas of the upper corresponding to the protrusions to alleviate these ailments. However, the padding wears out over time and becomes less effective in alleviating the ailments. Moreover, the extra padding in conventional footwear is not precisely anatomically positioned for alleviating the ailments.

Another problem associated with conventional footwear is that it does not conform to the structure of the foot because the upper, and the padding in particular, is not shaped like a foot. For example, many conventional shoes have scalloped collars for accommodating the ankle bones. The scallops of the collar are generally symmetric about a longitudinal centerline of the footwear. However, the ankle bones themselves are not symmetric about a longitudinal axis L of the foot. Rather, the tibial protrusion T is above and in front of the fibular protrusion F. As a result, the collar of the shoe does not conform to the protrusions, and the collar either rubs one of the protrusions or it does not support the ankle A. Because conventional footwear is not shaped to accommodate the ankle bones, the ailments discussed above are more likely to occur. The present invention takes into account the structure of the foot to reduce the likelihood of such ailments.

SUMMARY OF THE INVENTION

Among the several objects and features of the present invention may be noted the provision of footwear which corresponds to the shape of a foot; the provision of footwear which reduces ailments associated with the protrusions of a foot; and the provision of footwear which is comfortable to wear.

Briefly, apparatus of this invention is footwear including a sole for supporting a foot and an upper attached to the sole for covering the foot. The sole and upper define an interior of the footwear sized and shaped for receiving the foot. The upper has an inner surface adapted for engaging the foot when it is received in the interior of the footwear and an outer surface forming an exterior of the footwear. The upper also includes compressible cushioning permitting the upper to conform to the foot when it is received in the interior of the footwear to improve the fit of the footwear. The compressible cushioning is sized, shaped and positioned in the upper to at least partially surround a protrusion extending from the foot at a head of a metatarsal and is at least partially omitted from an area of the upper corresponding to the protrusion. Thus, a recess is formed in the upper for accommodating the protrusion to relieve pressure applied to the foot by the upper at the protrusion.

In another aspect the invention includes footwear comprising an upper formed from a first material having a first compressibility selected for cushioning corresponding areas of the foot and a second material having a second compressibility greater than the first compressibility selected for accommodating corresponding areas of the foot. The first material is sized, shaped and positioned on the upper for at least partially surrounding a protrusion extending from the foot at a distal head of a metatarsal. The second material is sized, shaped and positioned on an area of the upper corresponding to the protrusion so the upper applies less pressure to the protrusion than to portions of the foot surrounding the protrusion.

In yet another aspect of the present invention, the footwear comprises an upper having a compressible cushioning sized, shaped and positioned in the upper to at least partially surround a portion of a fifth toe of the foot corresponding to at least a portion of a fifth proximal phalanx of the foot. The cushioning is at least partially omitted from an area of the upper corresponding to the portion of the fifth toe thereby forming a recess in the upper for accommodating the portion of the fifth toe to relieve pressure applied to the foot by the upper.

In still another aspect, the present invention includes footwear comprising an upper formed from first and second materials. The first material is sized, shaped and positioned on the upper for at least partially surrounding a portion of a fifth toe of the foot corresponding to at least a portion of a fifth proximal phalanx of the foot, and the second material is sized, shaped and positioned on an area of the upper corresponding to the portion of the fifth toe so that the upper applies less pressure to the portion of the fifth toe than to adjacent portions of the foot.

In another aspect, footwear of the present invention includes compressible cushioning which is sized, shaped and positioned in the upper to at least partially surround a medial portion of an ankle corresponding to a distal head of a tibia, and which is at least partially omitted from an area of the upper corresponding to the medial portion of the ankle thereby forming a recess in the upper for accommodating the medial portion of the ankle to relieve pressure applied to the ankle by the upper.

The invention also includes footwear comprising an upper having compressible cushioning sized, shaped and positioned in the upper to at least partially surround a lateral portion of an ankle corresponding to a distal head of a fibula. The cushioning is at least partially omitted from an area of the upper corresponding to the lateral portion of the ankle thereby forming a recess in the upper for accommodating the lateral portion of the ankle to relieve pressure applied to the ankle by the upper.

In addition, the invention includes footwear having an upper formed from a first material and a second material. The first material is sized, shaped and positioned on the upper for at least partially surrounding a medial portion of an ankle including a distal head of a tibia. The second material is sized, shaped and positioned on an area of the upper corresponding to the medial portion of the ankle so the upper applies less pressure to the medial portion of the ankle than to adjacent portions of the ankle.

Finally, the present invention includes footwear having a first material sized, shaped and positioned on the upper for at least partially surrounding a lateral portion of an ankle including a distal head of a fibula and a second material sized, shaped and positioned on an area of the upper corresponding to the lateral portion of the ankle so the upper applies less pressure to the lateral portion of the ankle than to adjacent portions of the ankle.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
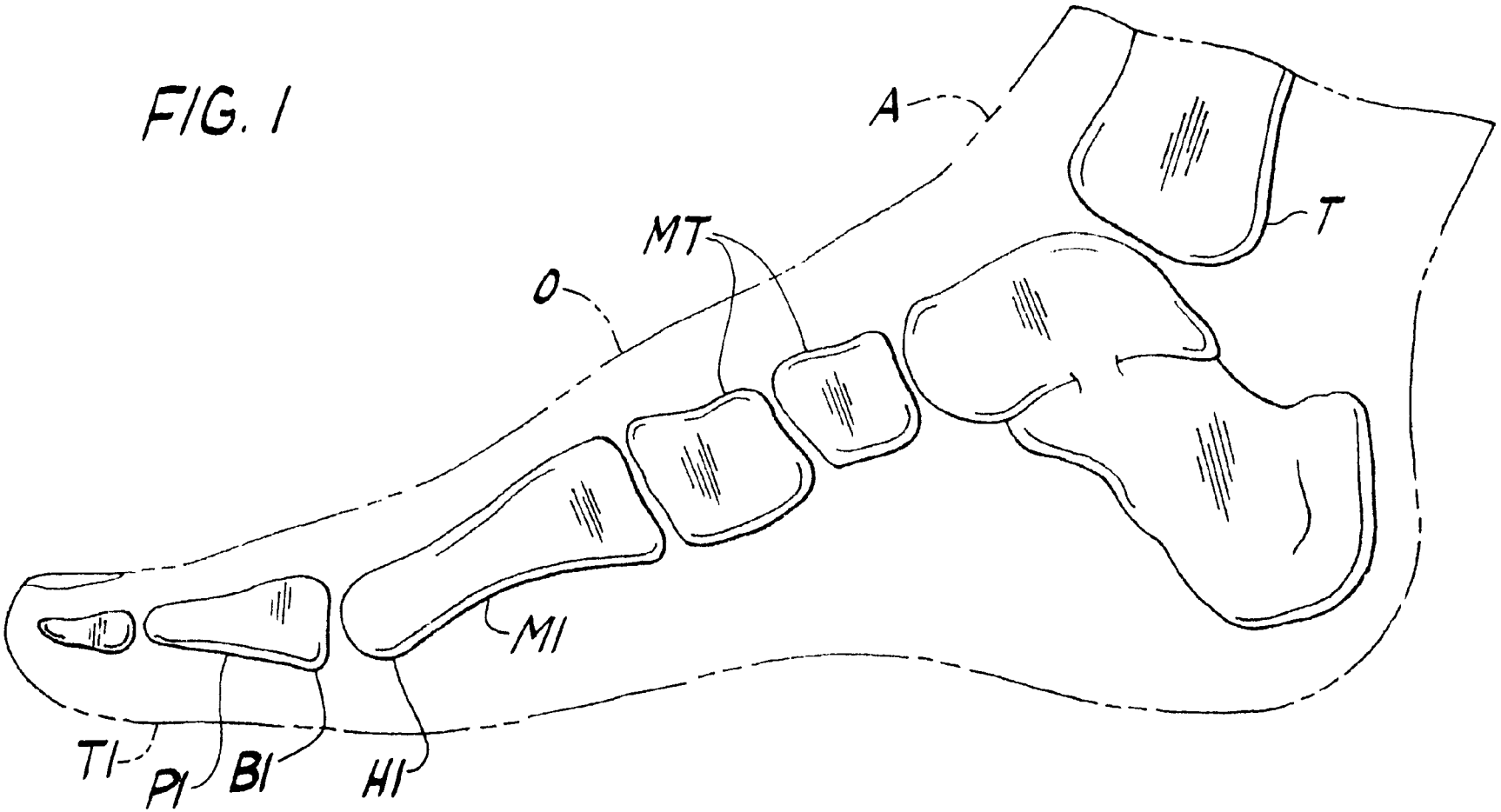
FIG. 1 is a medial side elevation of a foot showing interior skeletal structures.
Figure 2:
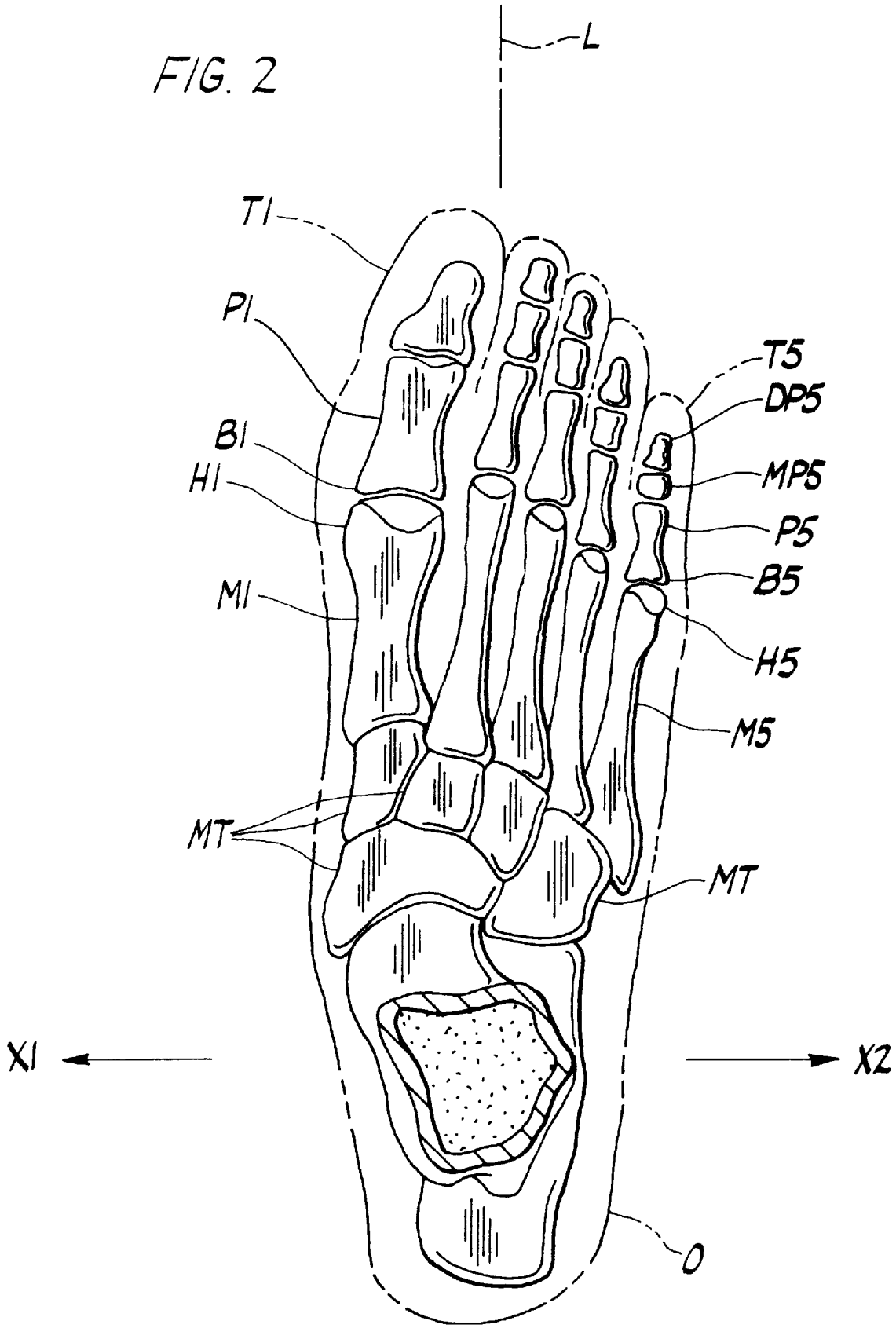
FIG. 2 is a top plan of the foot showing interior skeletal structures.
Figure 3:
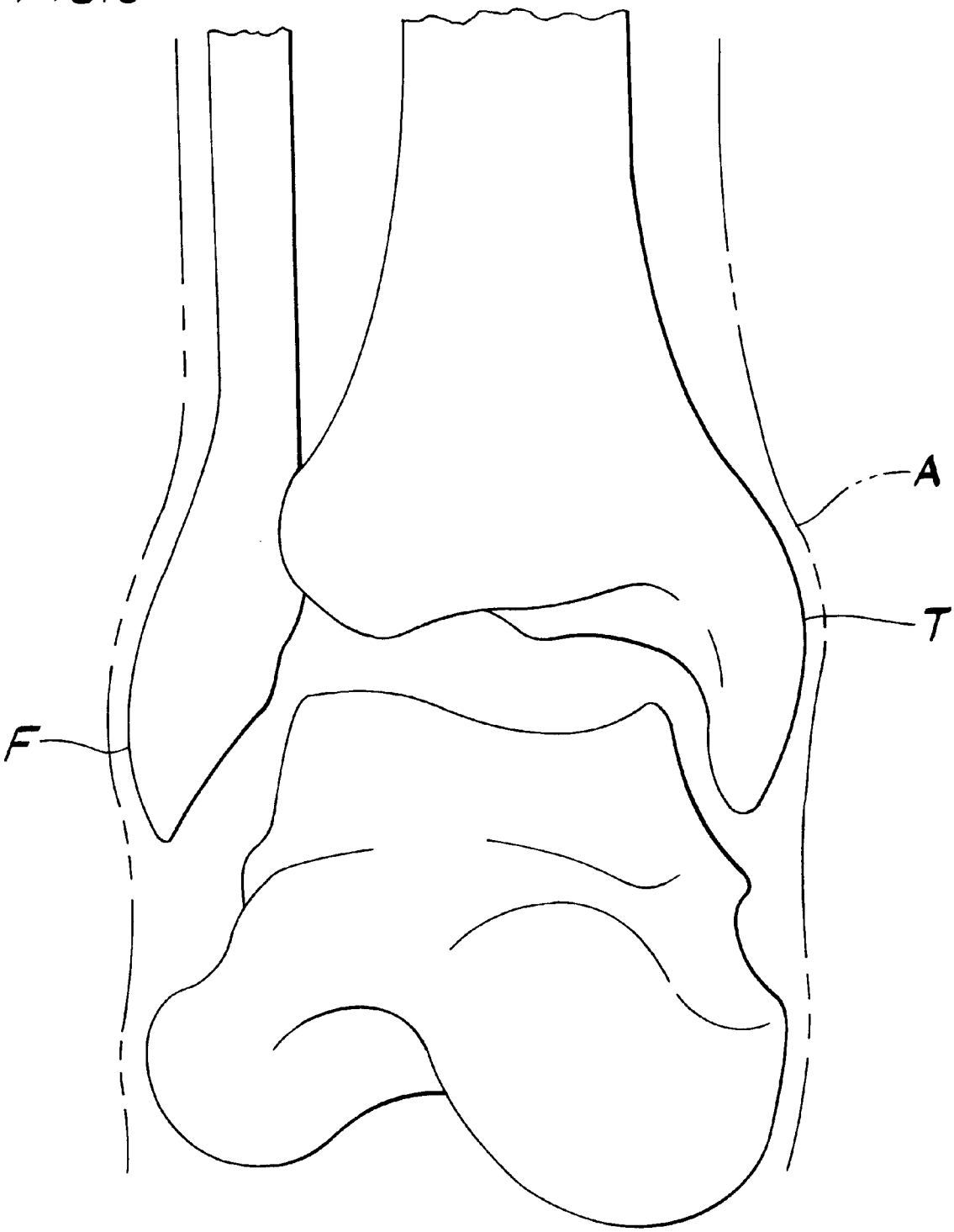
FIG. 3 is a front elevation of an ankle portion of the foot showing interior skeletal structures.
Figure 4:
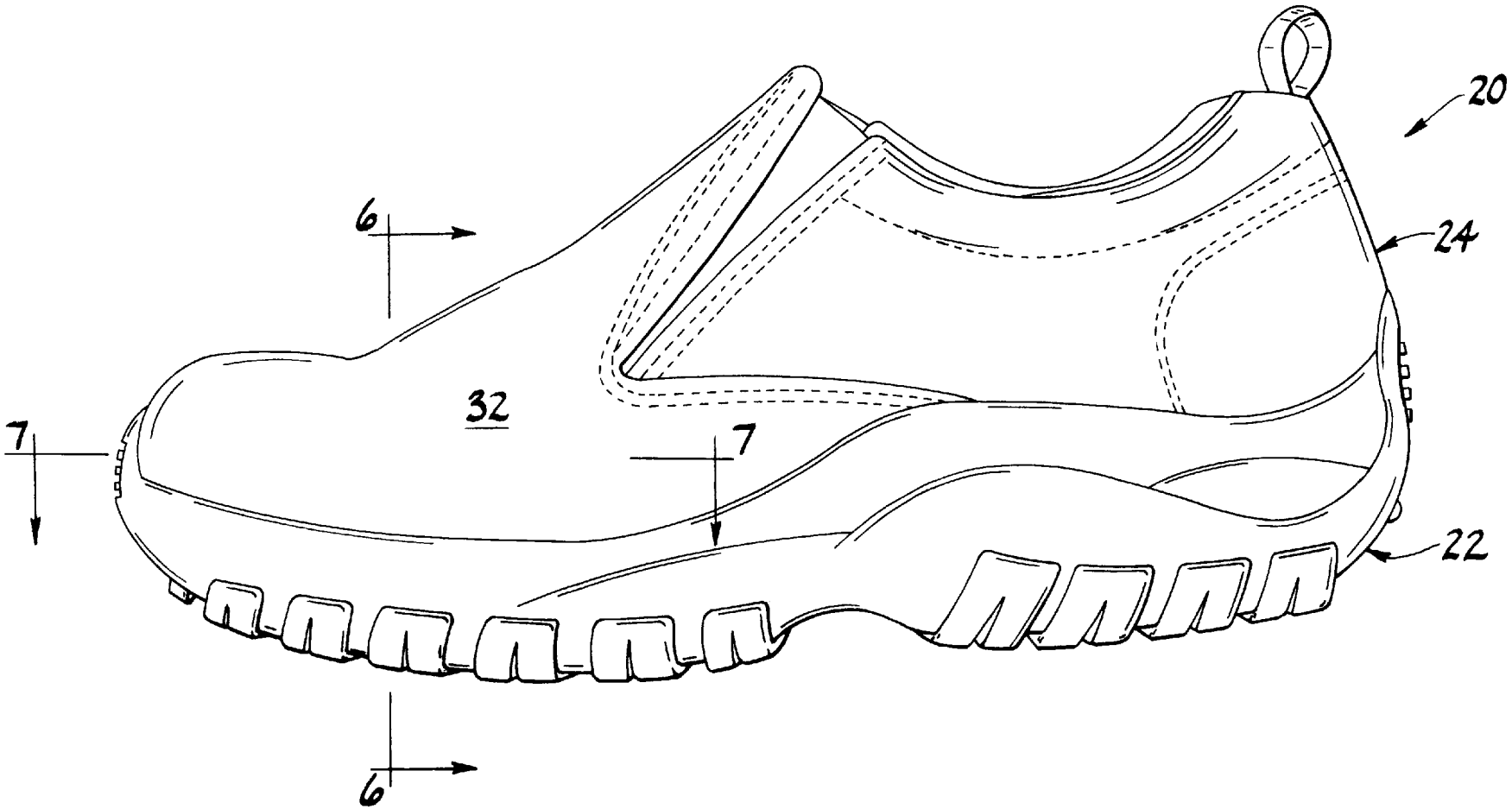
FIG. 4 is a medial side elevation of footwear of a first embodiment of the present invention.
Figure 5:
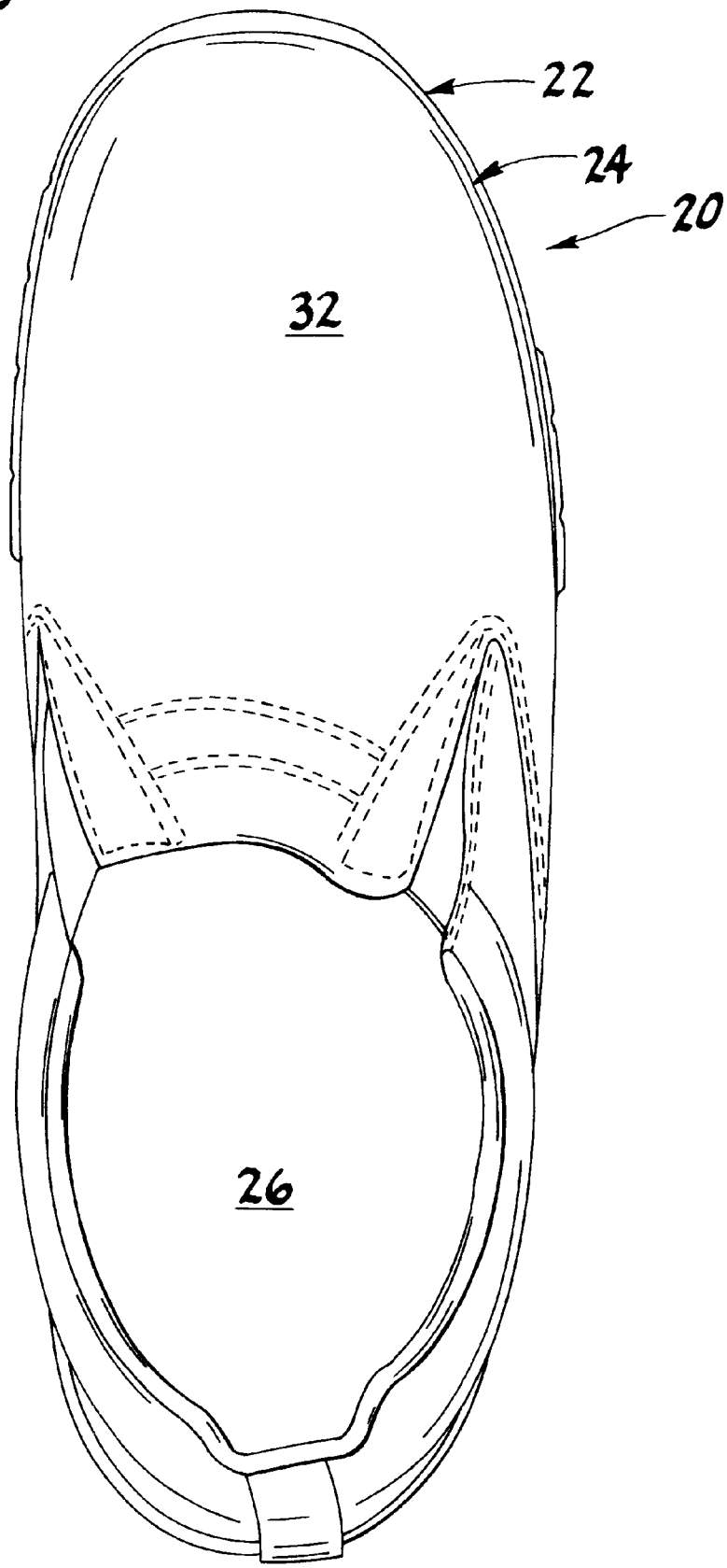
FIG. 5 is top plan of the footwear of the first embodiment.

Referring now to the drawings and in particular to FIGS. 4 and 5, footwear of a first embodiment of the present invention is designated in its entirety by the reference numeral 20. The footwear 20 includes a sole, generally designated by 22, for supporting a foot (not shown) and an upper, generally designated by 24, attached to the sole for covering the foot. As illustrated in FIG. 5, the sole 22 and upper 24 define an interior 26 of the footwear. The interior 26 is sized and shaped for receiving the foot.

Figure 6:
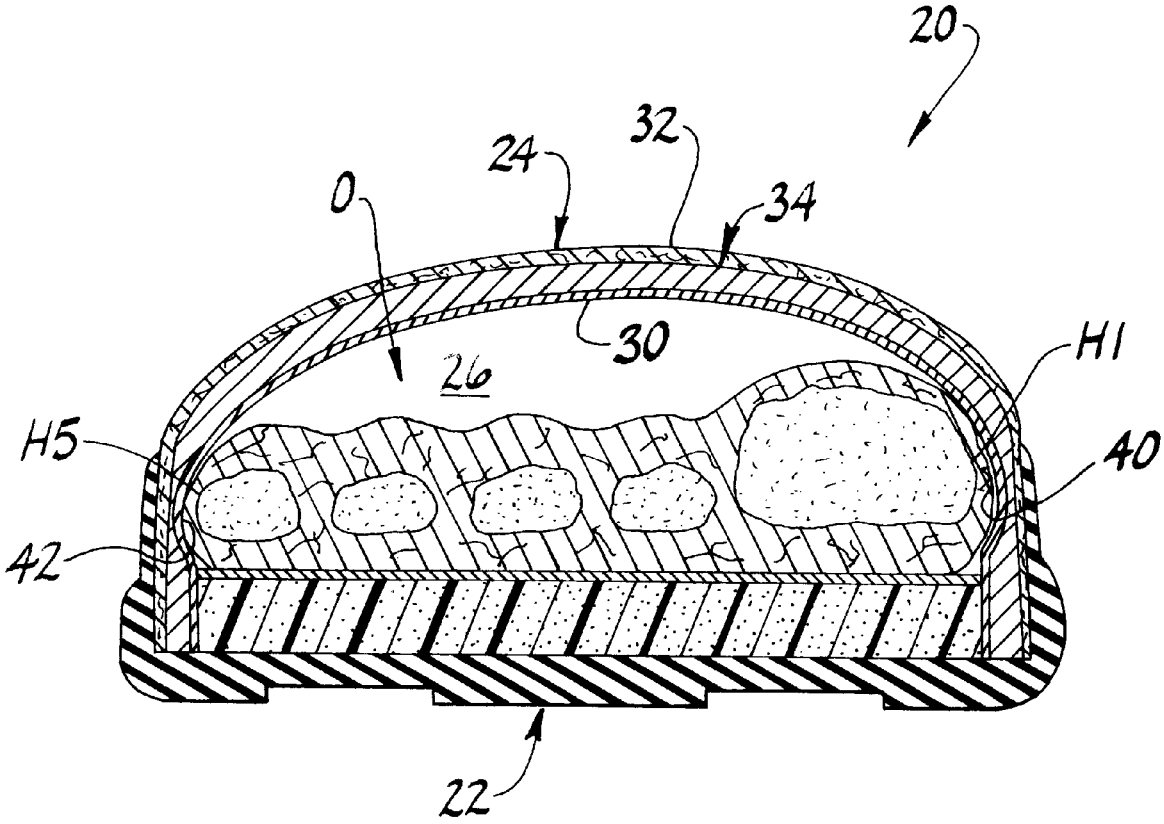
FIG. 6 is cross section of the footwear of the first embodiment taken in the plane of line 6—6 of FIG. 4.

As further illustrated in FIG. 6, the upper 24 includes a lining 30 forming an inner surface of the upper adapted for engaging the foot O when it is received in the interior 26 of the footwear 20. Although the lining 30 may be made of other materials without departing from the scope of the present invention, in the first embodiment the lining is made of cloth. The upper 24 also includes an outer shell 32 forming an outer surface of the upper and an exterior of the footwear 20. Although the shell 32 may be made of other materials without departing from the scope of the present invention, in the first embodiment the shell is made of leather. A compressible cushioning, generally designated by 34, is sandwiched between the lining 30 and the outer shell 32 for permitting the upper 24 to conform to the foot O when it is received in the interior 26 of the footwear 20 to improve the fit of the footwear. Although the cushioning 34 may be made of other materials without departing from the scope of the present invention, in the first embodiment the cushioning is made of an open cell foam. Alternatively, the cushioning 34 may be made of other conventional footwear materials such as gels, closed cell foams and synthetic rubbers. In addition, the lining 30, shell 32 and cushioning 34 may be assembled using any conventional means such as with adhesives or by sewing.

The compressible cushioning 34 is sized, shaped and positioned in the upper to at least partially surround one or more protrusions extending from the foot O. In the first preferred embodiment illustrated in FIGS. 6 and 7, the cushioning 34 at least partially surrounds the first and fifth metatarsal heads H1, H5, respectively, and a portion of a fifth toe T5 corresponding to a portion of a fifth proximal phalanx P5. Further, the cushioning 34 is at least partially omitted from areas on the upper 24 corresponding to these protrusions thereby forming recesses 40, 42 for accommodating the various protrusions to relieve pressure applied to the foot O by the upper at the protrusions.

Figure 7:
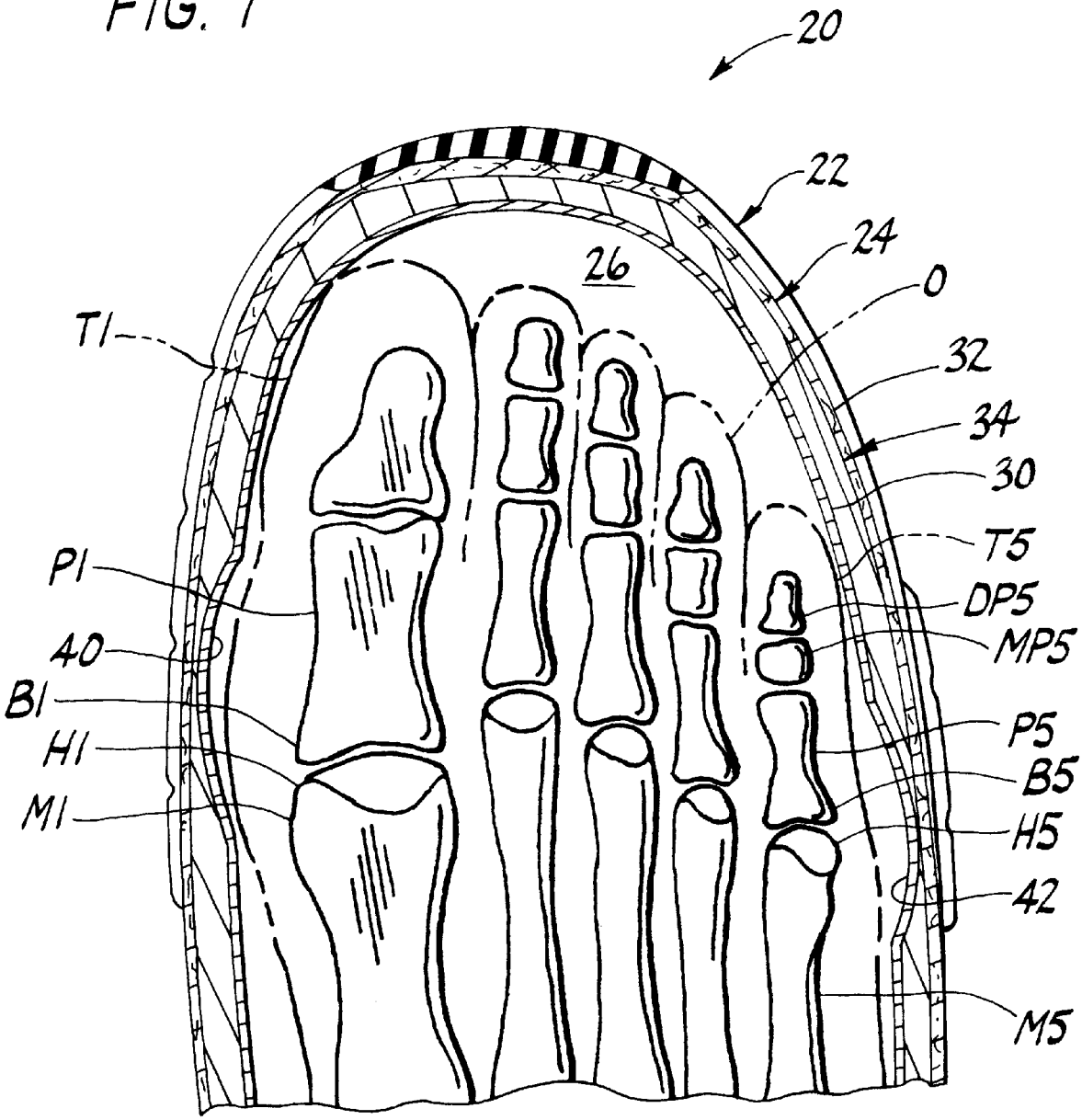
FIG. 7 is cross section of the footwear of the first embodiment taken in the plane of line 7—7 of FIG. 4.

The nominal sizes of the recesses 40, 42 will vary depending upon the size of the foot O. Measurements may be taken to determine the sizes of the recesses 40, 42. As an example, the recess 40 for accommodating the first metatarsal head H1 in footwear 20 sized for a typical adult female (e.g., size 9) is generally oval having a length of about 1¼ to about 1½ inches and a height of about one inch. Further, the recess 40 has a nominal depth of about ⅛ inch. The recess 42 for accommodating the fifth metatarsal head H5 and the portion of the fifth toe T5 corresponding to the fifth proximal phalanx P5 in footwear 20 sized for a typical adult male (e.g., size 10) is an highly elongate oval having a length of about 1½ to 2 inches and a height of about ½ to about ¾ inches. Further, the recess 42 has a nominal depth of about ⅛ inches. As illustrated in FIGS. 6 and 7, the recesses 40, 42 of the first preferred embodiment have generally rounded shapes and profiles. In addition, the recess 42 may be formed as two separate recesses—one recess for accommodating the head of the fifth metatarsal head H5 and one recess for accommodating the fifth proximal phalanx P5.

Figure 8:
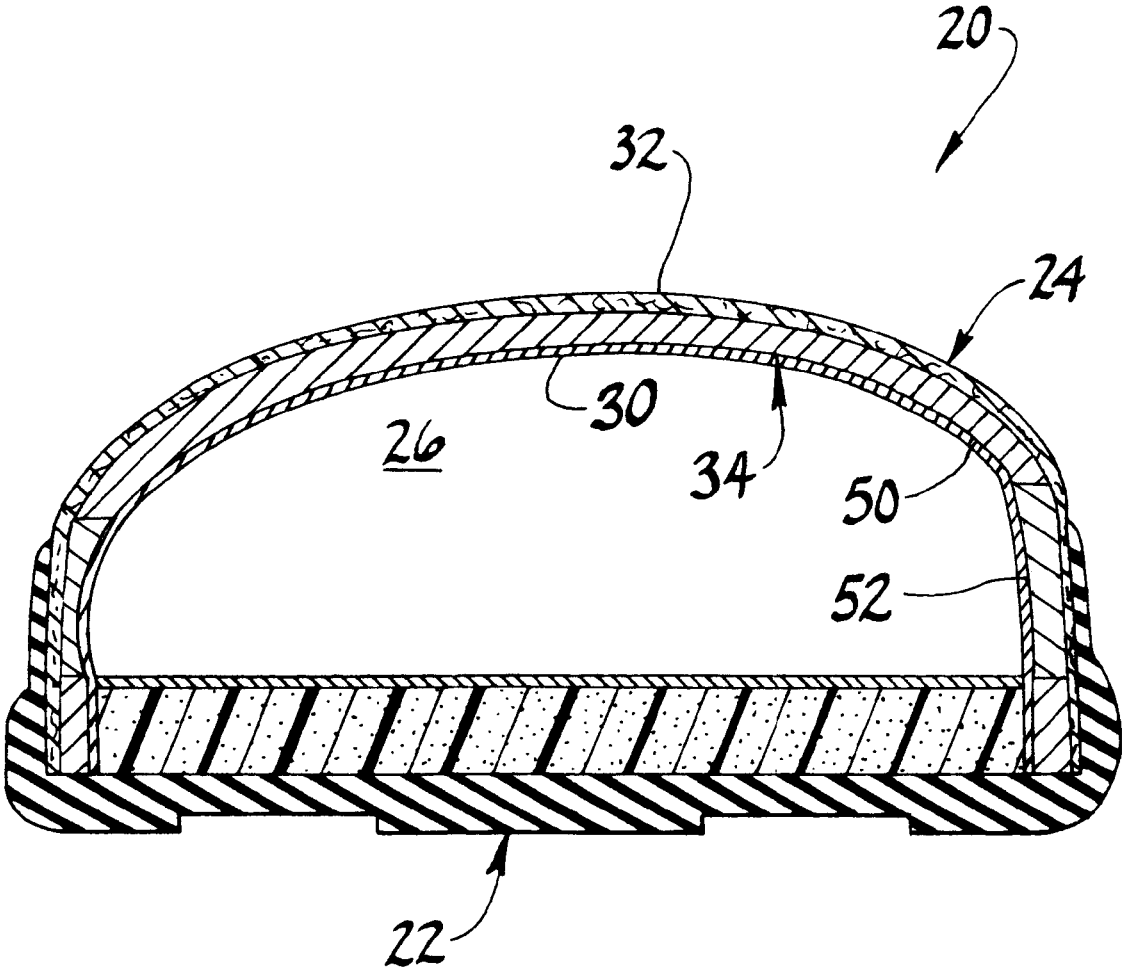
FIG. 8 is cross section of the footwear of a second embodiment taken in the plane of line 6—6 of FIG. 4.
Figure 9:
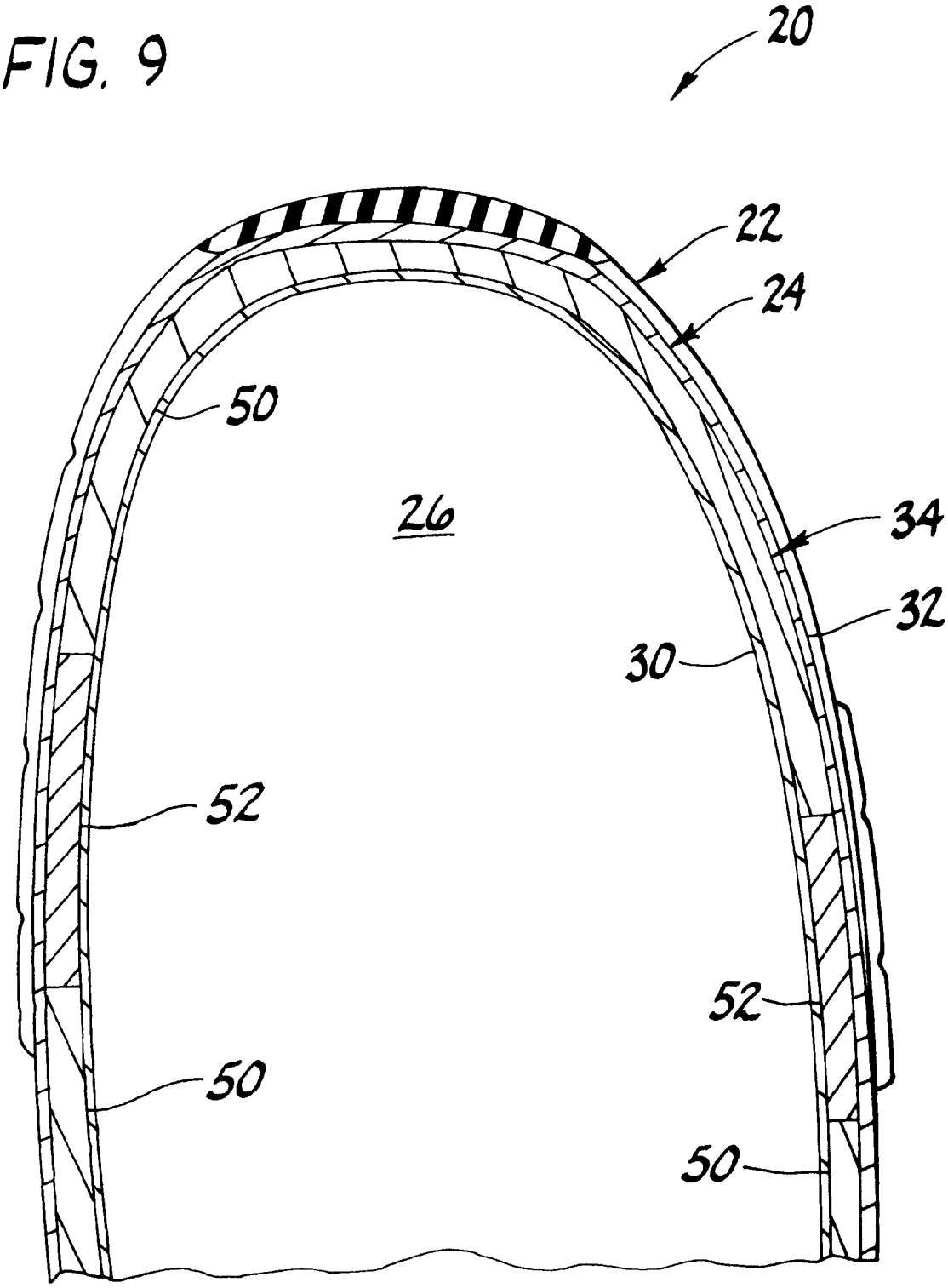
FIG. 9 is cross section of the footwear of a second embodiment taken in the plane of line 7—7 of FIG. 4.

In a second embodiment of the footwear 20 shown in FIG. 8, the cushioning 34 does not have recesses. Rather, the cushioning 34 is made of a softer (i.e., more compressible) material in the areas of the upper 24 which correspond to the protrusions so the cushioning compresses to accommodate the protrusions. Thus, the cushioning 34 is formed from a first material 50 having a first compressibility selected for cushioning corresponding areas of the foot O, and a second material 52 having a second compressibility greater than the first compressibility selected for accommodating corresponding areas of the foot O. The first material 50 is sized, shaped and positioned on the upper 24 for at least partially surrounding the protrusion extending from the foot. The second material 52 is sized, shaped and positioned on an area of the upper 24 corresponding to the location of the protrusion so that the upper applies less pressure to the protrusion than to portions of the foot O surrounding the protrusion. The parts of the upper 24 having the second material 52 are sized, shaped and positioned similar to the recesses 40, 42 in the footwear of the first embodiment. The first and second materials 50, 52 may have different chemistries from each other or they may have similar chemistries. Where the materials 50, 52 have the same chemistries, they may be integrally formed and the second material may be perforated or otherwise weakened to provide increased compressibility. Other features of the footwear 20 of the second embodiment are similar to those of the footwear of the first embodiment and will not be described in further detail.

Figure 10:
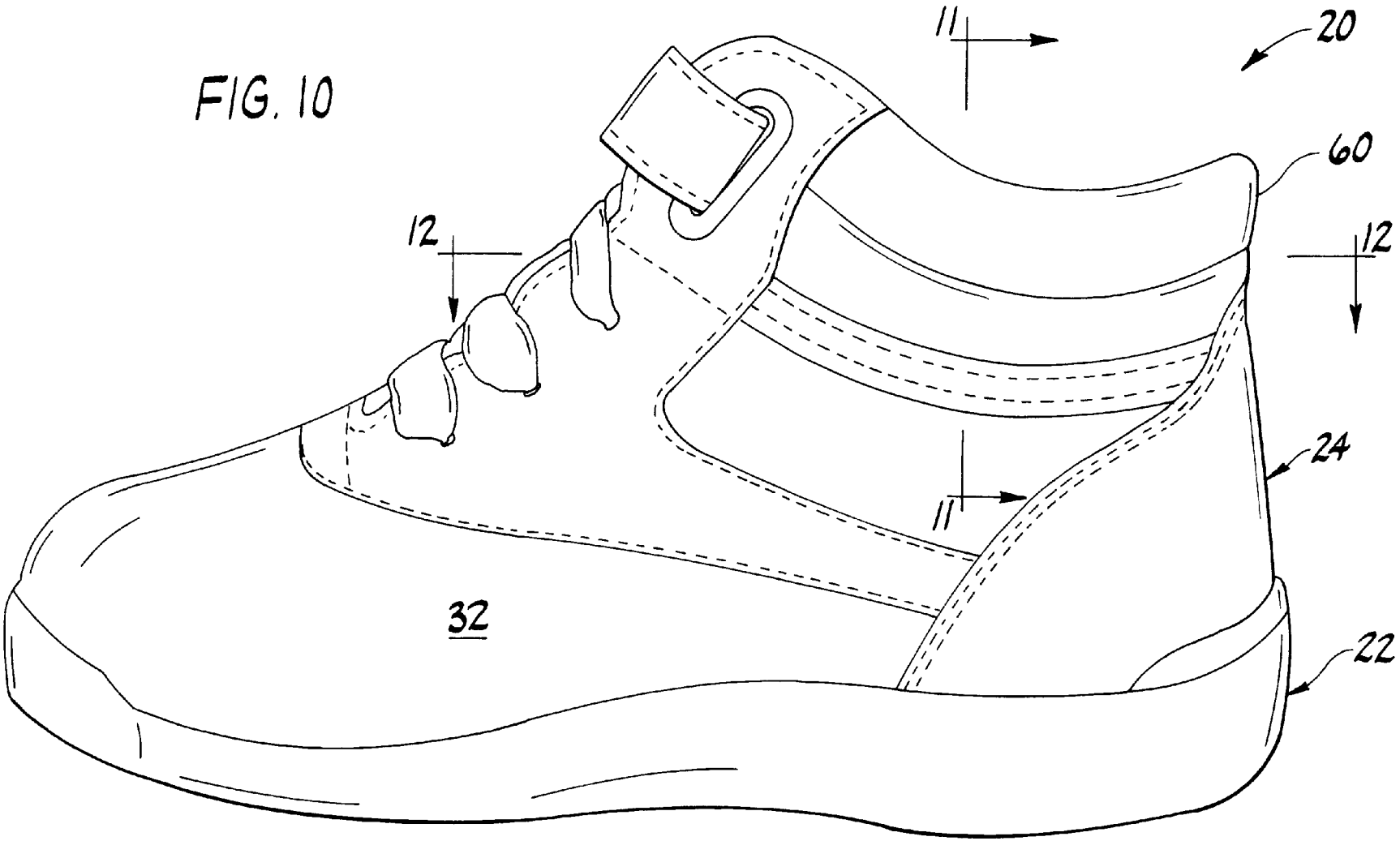
FIG. 10 is a medial side elevation of footwear of a third embodiment of the present invention.
Figure 11:
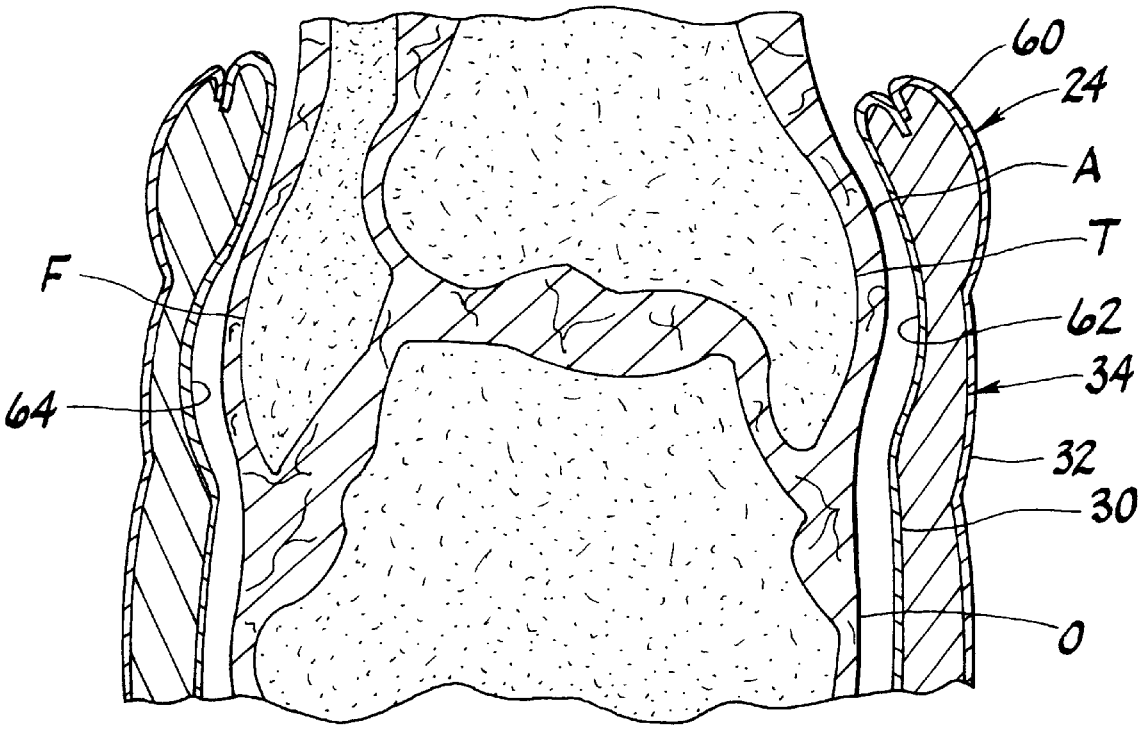
FIG. 11 is cross section of the footwear of the third embodiment taken in the plane of line 11—11 of FIG. 10.
Figure 12:
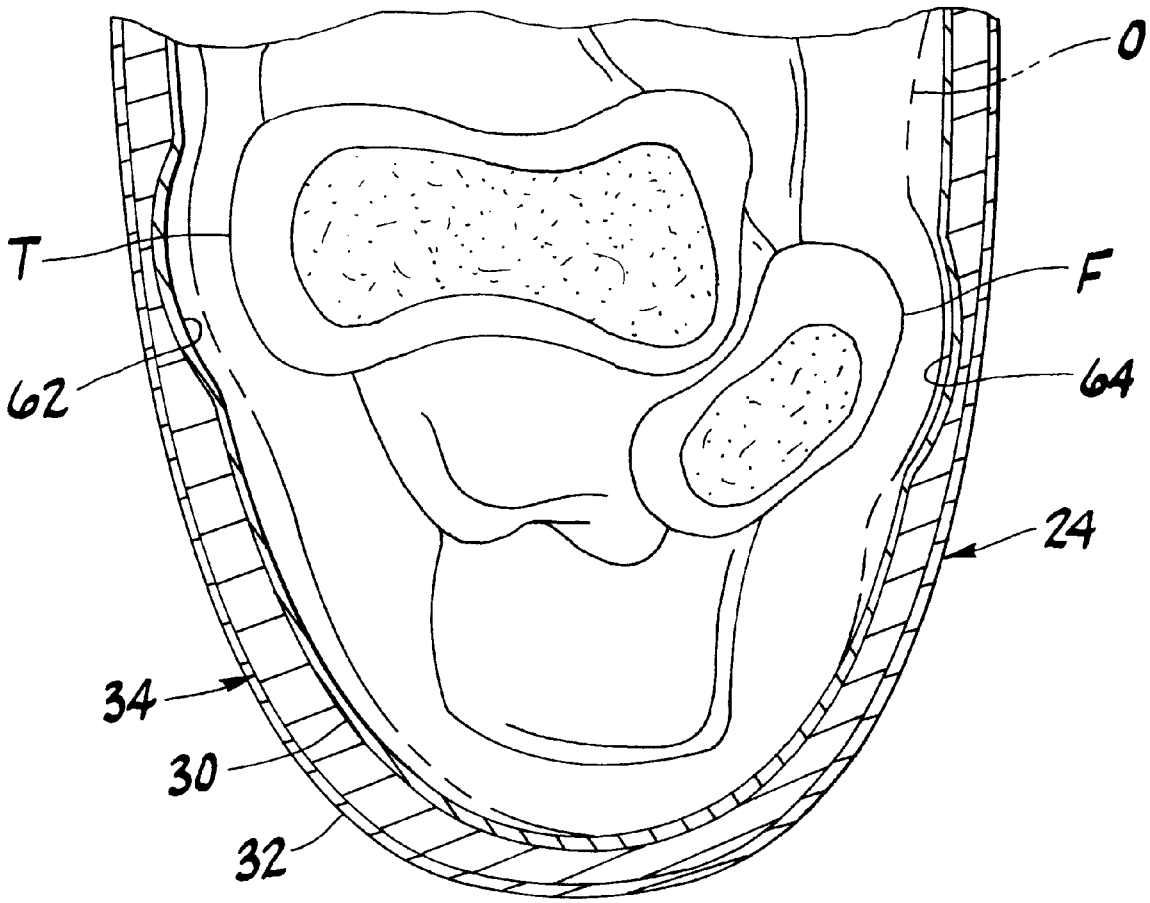
FIG. 12 is cross section of the footwear of the third embodiment taken in the plane of line 12—12 of FIG. 10.

As illustrated in FIGS. 10–12, footwear 20 of a third embodiment has a collar 60 which extends above the distal heads of the tibia T and fibula F. As with the first and second embodiments, the upper 24 of the footwear 20 of the third embodiment has a lining 30, an outer shell 32 and a compressible cushioning 34 sandwiched between the lining and the outer shell. In addition to the recesses 40, 42 described above with respect to the first embodiment, the cushioning 34 of the footwear 20 of the third embodiment is sized, shaped and positioned in the upper 24 to at least partially surround a medial portion and a lateral portion of an ankle A corresponding to a distal head of a tibia T and a distal head of a fibula F when the foot O is in the interior 26 of the footwear 20. The cushioning 34 is omitted from an area of the upper 24 corresponding to the distal heads of the tibia T and fibular F thereby forming recesses 62, 64 in the upper for accommodating the portions of the ankle A to relieve pressure applied to the ankle by the upper.

The nominal sizes of the recesses 62, 64 will vary depending upon the size of the foot O. As an example, the recess 62 for accommodating the distal head of the tibia T in footwear 20 sized for a typical adult male (e.g., size 10) is generally oval having a length of about 1½ to about 1¾ inches and a height of about 1¼ to about 1½ inches. The recess 64 for accommodating the distal head of the fibula F in footwear 20 sized for a typical adult male is generally oval having a length of about 1 to about 1¼ inches and a height of about 1¼ to about 1½ inches. Further, the recesses 62, 64 have a nominal depth of about ⅛ to about 3⁄16 inch. Moreover, the fibular recess 64 is preferably below and behind the tibial recess 62. Most preferably, the fibular recess 64 is offset rearward from the tibial recess 62 by a distance of about ½ to about ¾ inches measured in a horizontal plane as shown in FIG. 12, and offset downward by a distance of about ½ to about ¾ inches in a vertical plane as shown in FIG. 11. Further, it is envisioned that the upper portions of the cushioning 34 and the recesses 62, 64 may be omitted in footwear 20 having a low collar 60. It is also envisioned that the recesses 62, 64 may have open bottoms forming openings through the upper 24 for accommodating the corresponding portion of the ankle without departing from the scope of the present invention.

Although the cushioning 34 surrounding the various portions of the foot O is illustrated as being unitary, those skilled in the art will appreciate that the cushioning may be formed from more than one piece and/or in more than one layer without departing from the scope of the present invention. Further, the cushioning 34 of the third embodiment may be made from two materials similarly to the cushioning of the second embodiment without departing from the scope of the present invention. Still further as will be appreciated by those skilled in the art, the areas of the upper 24 corresponding to the protrusions preferably do not contain seams to avoid abrasiveness, inelasticity and stiffness in these areas.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. Footwear comprising a sole for supporting a foot and an upper attached to the sole for covering the foot, said sole and upper defining an interior of the footwear sized and shaped for receiving the foot, said upper having an inner surface adapted for engaging the foot when it is received in the interior of the footwear, an outer surface forming an exterior of the footwear, and compressible cushioning positioned between said inner surface and said outer surface, said cushioning permitting the upper to conform to the foot when it is received in the interior of the footwear to improve the fit of the footwear, said compressible cushioning being sized, shaped and positioned in the upper to at least partially surround a protrusion extending from the foot at a head of a metatarsal of the foot and being at least partially omitted from an area of the upper corresponding to said protrusion of the foot thereby forming a recess in the upper for accommodating said protrusion to relieve pressure applied to the foot by the upper at said protrusion.

2. Footwear as set forth in claim 1 wherein said compressible cushioning is sized, shaped and positioned in the upper to at least partially surround the protrusion extending from the foot at a distal head of a first metatarsal of the foot, and is at least partially omitted from the area of the upper corresponding to said protrusion of the foot thereby forming the recess in the upper for accommodating said protrusion to relieve pressure applied to the foot by the upper at said protrusion.

3. Footwear as set forth in claim 2 wherein said protrusion is a first protrusion, said recess is a first recess, and said compressible cushioning is sized, shaped and positioned in the upper to at least partially surround a second protrusion extending from the foot at a distal head of a fifth metatarsal of the foot, and is at least partially omitted from an area of the upper corresponding to said second protrusion of the foot thereby forming a second recess in the upper for accommodating said second protrusion to relieve pressure applied to the foot by the upper at said second protrusion.

4. Footwear as set forth in claim 3 wherein said compressible cushioning is sized, shaped and positioned in the upper to at least partially surround a portion of a fifth toe of the foot corresponding to at least a portion of a fifth proximal phalanx of the foot, and is at least partially omitted from an area of the upper corresponding to said portion of the fifth toe so said second recess in the upper further accommodates said portion of the fifth toe to relieve pressure applied to the foot by the upper at said toe.

5. Footwear as set forth in claim 2 wherein said compressible cushioning is sized, shaped and positioned in the upper to at least partially surround a portion of a fifth toe of the foot corresponding to at least a portion of a fifth proximal phalanx of the foot, and is at least partially omitted from an area of the upper corresponding to said portion of the fifth toe thereby forming a second recess in the upper for accommodating said portion of the fifth toe to relieve pressure applied to the foot by the upper at said toe.

6. Footwear as set forth in claim 1 wherein said compressible cushioning is sized, shaped and positioned in the upper to at least partially surround the protrusion extending from the foot at the distal head of a fifth metatarsal of the foot, and is at least partially omitted from the area of the upper corresponding to said protrusion of the foot thereby forming the recess in the upper for accommodating said protrusion to relieve pressure applied to the foot by the upper at said protrusion.

7. Footwear as set forth in claim 6 wherein said compressible cushioning is sized, shaped and positioned in the upper to at least partially surround a portion of a fifth toe of the foot corresponding to at least a portion of a fifth proximal phalanx of the foot, and is at least partially omitted from an area of the upper corresponding to said portion of the fifth toe so the recess in the upper further accommodates said portion of the fifth toe to relieve pressure applied to the foot by the upper at said toe.

8. Footwear comprising a sole for supporting a foot and an upper attached to the sole for covering the foot, said upper having an inner surface adapted for engaging the foot when it is received in an interior of the footwear sized and shaped for receiving the foot, an outer surface forming an exterior of the footwear, and compressible cushioning positioned between said inner surface and said outer surface, said cushioning being formed from a first material having a first compressibility selected for cushioning corresponding areas of the foot, and a second material having a second compressibility greater than said first compressibility selected for accommodating corresponding areas of the foot, said first material being sized, shaped and positioned on the upper for at least partially surrounding a protrusion extending from the foot at a distal head of a metatarsal of the foot when the foot is in the interior of the footwear, and said second material being sized, shaped and positioned on an area of the upper corresponding to the protrusion so that the upper applies less pressure to the protrusion than to portions of the foot surrounding the protrusion.

9. Footwear as set forth in claim 8 wherein said first material is sized, shaped and positioned on the upper for at least partially surrounding a protrusion extending from the foot at a distal head of a first metatarsal of the foot when the foot is in the interior of the footwear, and said second material is sized, shaped and positioned on an area of the upper corresponding to the protrusion.

10. Footwear as set forth in claim 9 wherein said protrusion is a first protrusion, and said first material is sized, shaped and positioned on the upper for at least partially surrounding a second protrusion extending from the foot at a distal head of a fifth metatarsal of the foot when the foot is in the interior of the footwear, and said second material is sized, shaped and positioned on an area of the upper corresponding to said second protrusion.

11. Footwear as set forth in claim 10 wherein said first material is sized, shaped and positioned in the upper to at least partially surround a portion of a fifth toe of the foot corresponding to at least a portion of a fifth proximal phalanx of the foot when the foot is in the interior of the footwear, and said second material is sized, shaped and positioned on an area of the upper corresponding to said portion of the fifth toe.

12. Footwear as set forth in claim 9 wherein said first material is sized, shaped and positioned in the upper to at least partially surround a portion of a fifth toe of the foot corresponding to at least a portion of a fifth proximal phalanx of the foot when the foot is in the interior of the footwear, and said second material is sized, shaped and positioned on an area of the upper corresponding to said portion of the fifth toe.

13. Footwear as set forth in claim 8 wherein said first material is sized, shaped and positioned on the upper for at least partially surrounding a protrusion extending from the foot at a distal head of a fifth metatarsal of the foot when the foot is in the interior of the footwear, and said second material is sized, shaped and positioned on an area of the upper corresponding to said protrusion.

14. Footwear as set forth in claim 13 wherein said first material is sized, shaped and positioned in the upper to at least partially surround a portion of a fifth toe of the foot corresponding to at least a portion of a fifth proximal phalanx of the foot when the foot is in the interior of the footwear, and said second material is sized, shaped and positioned on an area of the upper corresponding to said portion of the fifth toe.

15. Footwear comprising a sole for supporting a foot and an upper attached to the sole for covering the foot, said sole and upper defining an interior of the footwear sized and shaped for receiving the foot, said upper having an inner surface adapted for engaging the foot when it is received in the interior of the footwear, an outer surface forming an exterior of the footwear, and compressible cushioning positioned between said inner surface and said outer surface, said cushioning permitting the upper to conform to the foot when it is received in the interior of the footwear to improve the fit of the footwear, said compressible cushioning being sized, shaped and positioned in the upper to at least partially surround a portion of a fifth toe of the foot corresponding to at least a portion of a fifth proximal phalanx of the foot when the foot is in the interior of the footwear, and being at least partially omitted from an area of the upper corresponding to said portion of the fifth toe thereby forming a recess in the upper for accommodating said portion of the fifth toe to relieve pressure applied to the foot by the upper at said toe.

16. Footwear comprising a sole for supporting a foot and an upper attached to the sole for covering the foot, said upper having an inner surface adapted for engaging the foot when it is received in an interior of the footwear sized and shaped for receiving the foot, an outer surface forming an exterior of the footwear, and compressible cushioning positioned between said inner surface and said outer surface, said cushioning being formed from a first material having a first compressibility selected for cushioning corresponding areas of the foot, and a second material having a second compressibility greater than said first compressibility for accommodating corresponding areas of the foot, said first material being sized, shaped and positioned on the upper for at least partially surrounding a portion of a fifth toe of the foot corresponding to at least a portion of a fifth proximal phalanx of the foot when the foot is in the interior of the footwear, and said second material being sized, shaped and positioned on an area of the upper corresponding to said portion of the fifth toe so that the upper applies less pressure to said portion of the fifth toe than to adjacent portions of the foot.

* * * * *